US011633638B2

(12) United States Patent
Corrigan

(10) Patent No.: US 11,633,638 B2
(45) Date of Patent: Apr. 25, 2023

(54) FIRE HOSE REELING SYSTEM

(71) Applicant: Daniel James Corrigan, Lakeville, MN (US)

(72) Inventor: Daniel James Corrigan, Lakeville, MN (US)

( * ) Notice: Subject to any disclaimer, the term of this patent is extended or adjusted under 35 U.S.C. 154(b) by 158 days.

(21) Appl. No.: 17/235,276

(22) Filed: Apr. 20, 2021

(65) Prior Publication Data

US 2022/0331630 A1 Oct. 20, 2022

(51) Int. Cl.

| | |
|---|---|
| ***A62C 33/04*** | (2006.01) |
| ***B65H 54/58*** | (2006.01) |
| ***B65H 75/44*** | (2006.01) |
| ***B65H 75/40*** | (2006.01) |

(52) U.S. Cl.

CPC ..... *A62C 33/04* (2013.01); *B65H 54/585* (2013.01); *B65H 75/403* (2013.01); *B65H 75/4402* (2013.01); *B65H 75/4494* (2013.01); *B65H 2701/332* (2013.01)

(58) Field of Classification Search

None

See application file for complete search history.

(56) References Cited

U.S. PATENT DOCUMENTS

| | | | | |
|---|---|---|---|---|
| 4,592,519 | A | 6/1986 | Peacock | |
| 5,033,690 | A | 7/1991 | McIver | |
| 5,388,609 | A * | 2/1995 | Ghio | A62C 33/04 137/355.27 |
| 5,988,559 | A | 11/1999 | Gnass | |
| 6,206,317 | B1 | 3/2001 | Harvestine | |
| 6,241,175 | B1 | 6/2001 | Nichols | |
| 6,811,110 | B2 | 11/2004 | Tsao | |
| 8,955,786 | B2 | 2/2015 | Motoji | |
| 2002/0043593 | A1 * | 4/2002 | Leach | B65H 75/4463 248/75 |
| 2003/0192979 | A1 | 10/2003 | Olson | |
| 2004/0089761 | A1 * | 5/2004 | Tsao | A62C 33/04 242/532.6 |
| 2009/0166461 | A1 | 7/2009 | Terrell | |
| 2011/0220756 | A1 * | 9/2011 | Mosher | B65H 75/4492 242/476.1 |
| 2020/0087102 | A1 * | 3/2020 | Russell | B65H 75/30 |

FOREIGN PATENT DOCUMENTS

| | | | | |
|---|---|---|---|---|
| CA | 2314667 | A1 * | 1/2001 | B65H 54/585 |

* cited by examiner

*Primary Examiner* — Steven M Marsh

(57) ABSTRACT

A fire hose reeling system includes a support frame that is positionable on a ground surface. The support frame has a first lateral edge and a second lateral edge. A reel apparatus is mounted on the support frame. The reel apparatus releasably engages a fire hose and forms the hose into a roll when the reel apparatus is actuated. A stabilizing panel has a perimeter edge pivotally coupled to the support frame such that the stabilizing panel is positionable in an upright position defining a stored position or in deployed position extending away from the first lateral edge. When in the deployed position, the stabilizing panel abuts the ground surface and is stepped upon while the reel apparatus is used to stabilize the assembly.

18 Claims, 12 Drawing Sheets

FIRE HOSE REELING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fire hose rolling facilitating device and more particularly pertains to a new fire hose rolling facilitating device for facilitating the rolling of a fire hose in a very quick manner such that the fire hose can be properly stowed. Moreover, the device includes parts that may be easily disassembled for storage and transportation purposes.

(2) Description of Related Art Including Information Disclosed Under 37 CFR 1.97 and 1.98

The prior art relates to fire hose rolling devices for assisting a person in rolling a fire hose into a roll or coil for storage purposes. Most often, after a fire hose has been used, it is laid out lengthwise and then rolled onto itself to form a generally tight coil. This is done to remove water from the fire hoses, reduce the size of fire hose for storage and transportation, and to retain the fire hose in a non-kinked condition to increase the life of the fire hose and to ensure that it may be easily unrolled quickly for its next usage. However, the process of laying out the fire hose and rolling it out is both time and energy consumptive. For that reason, devices have been utilized to assist in the rolling process and typically include conventional spool and spindle combinations for rolling a fire hose onto the spool. These devices tend to be heavy, not easily movable, and include storage and transportation difficulties when being stowed due the vehicle limitations placed on firefighting personnel.

BRIEF SUMMARY OF THE INVENTION

An embodiment of the disclosure meets the needs presented above by generally comprising a support frame is positionable on a ground surface. The support frame has a front end, a rear end, a first lateral edge and a second lateral edge. A reel apparatus is mounted on the post adjacent to the upper end. The reel apparatus is configured to releasably engage a fire hose and form the hose into a roll when the reel apparatus is actuated. A stabilizing panel has an upper surface, a lower surface and a perimeter edge. The perimeter edge includes an interior edge and an exterior edge positioned opposite of each other. The stabilizing panel is pivotally coupled to the support frame such that the interior edge is adjacent to the first lateral edge. The stabilizing panel is positioned in an upright position defining a stored position or in deployed position extending away from the first lateral edge. The stabilizing panel abuts the ground surface and is stepped upon when the reel apparatus is used to stabilize the assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
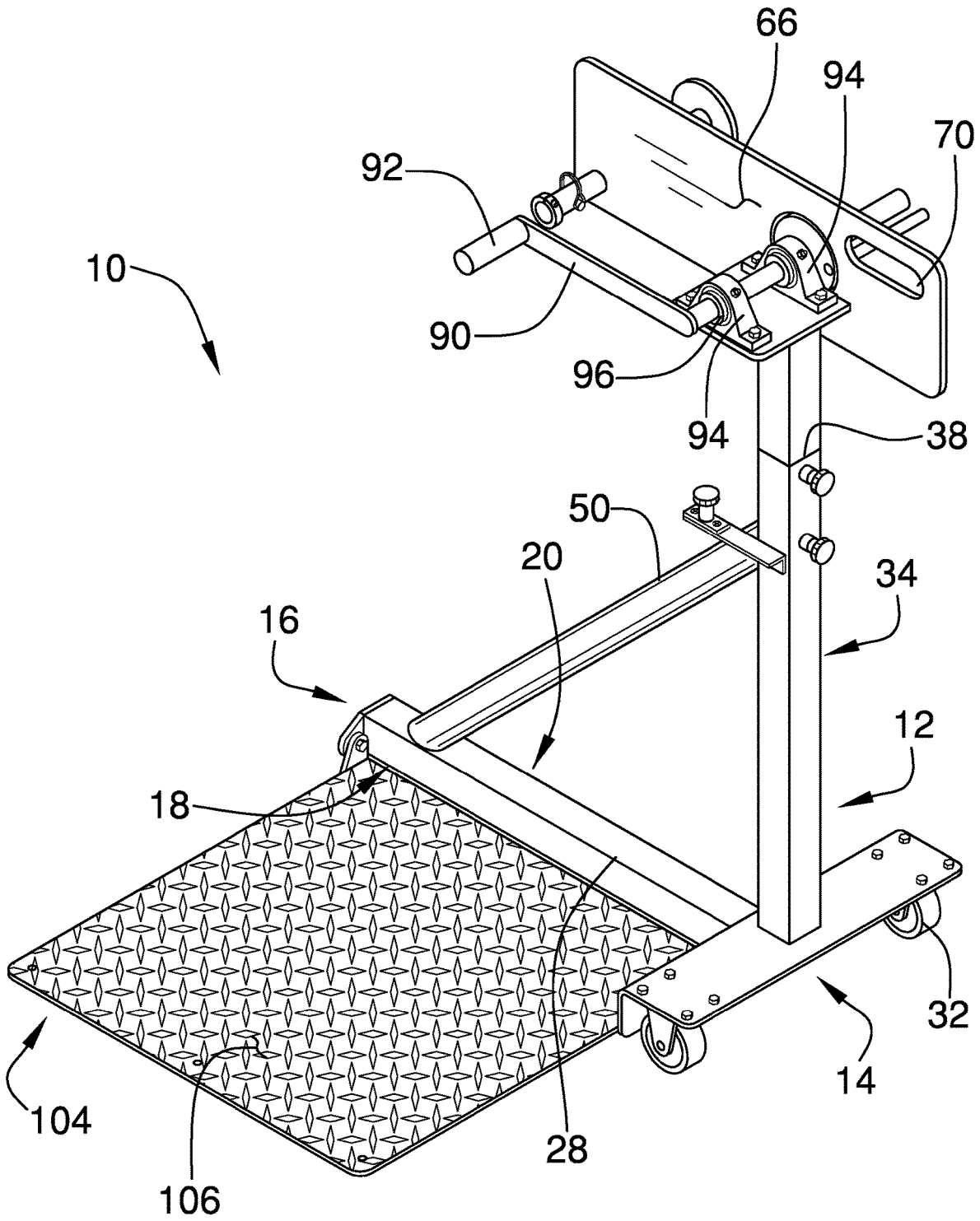
FIG. 1 is a left, top isometric view of a fire hose reeling system according to an embodiment of the disclosure.

With reference now to the drawings, and in particular to FIGS. 1 through 12 thereof, a new fire hose rolling facilitating device embodying the principles and concepts of an embodiment of the disclosure and generally designated by the reference numeral 10 will be described.

As best illustrated in FIGS. 1 through 12, the fire hose reeling system 10 generally comprises a support frame 12 that is positionable on a ground surface and as shown in FIG. 1 has, for explanation purposes, a front end 14, a rear end 16, a first lateral edge 18 and a second lateral edge 20. The support frame 12 more generally includes a base 22 that has a top side 24 and a bottom side 26. In one embodiment, the base 22 includes a first member 28 and a second member 30 that are orientated perpendicular to each other such that the first member 28 extends away from a central area of the second member 30 to form a "T" shape. In this configuration, the second member 30 includes the front end 14 and the first and 18 and second 20 lateral edges extend along opposite edges of the first member 28. A plurality of wheels 32 may be attached to and extends downwardly from the bottom side 26. As is in shown in the Figures, the wheels 32 may be located on the second member 28 only and adjacent to the front end 14 for reasons which will be explained below. The base 22 may have any size suitable for supporting the system 10 but will typically have an overall footprint less than 5.0 feet long by 5.0 feet wide.

Figure 2:
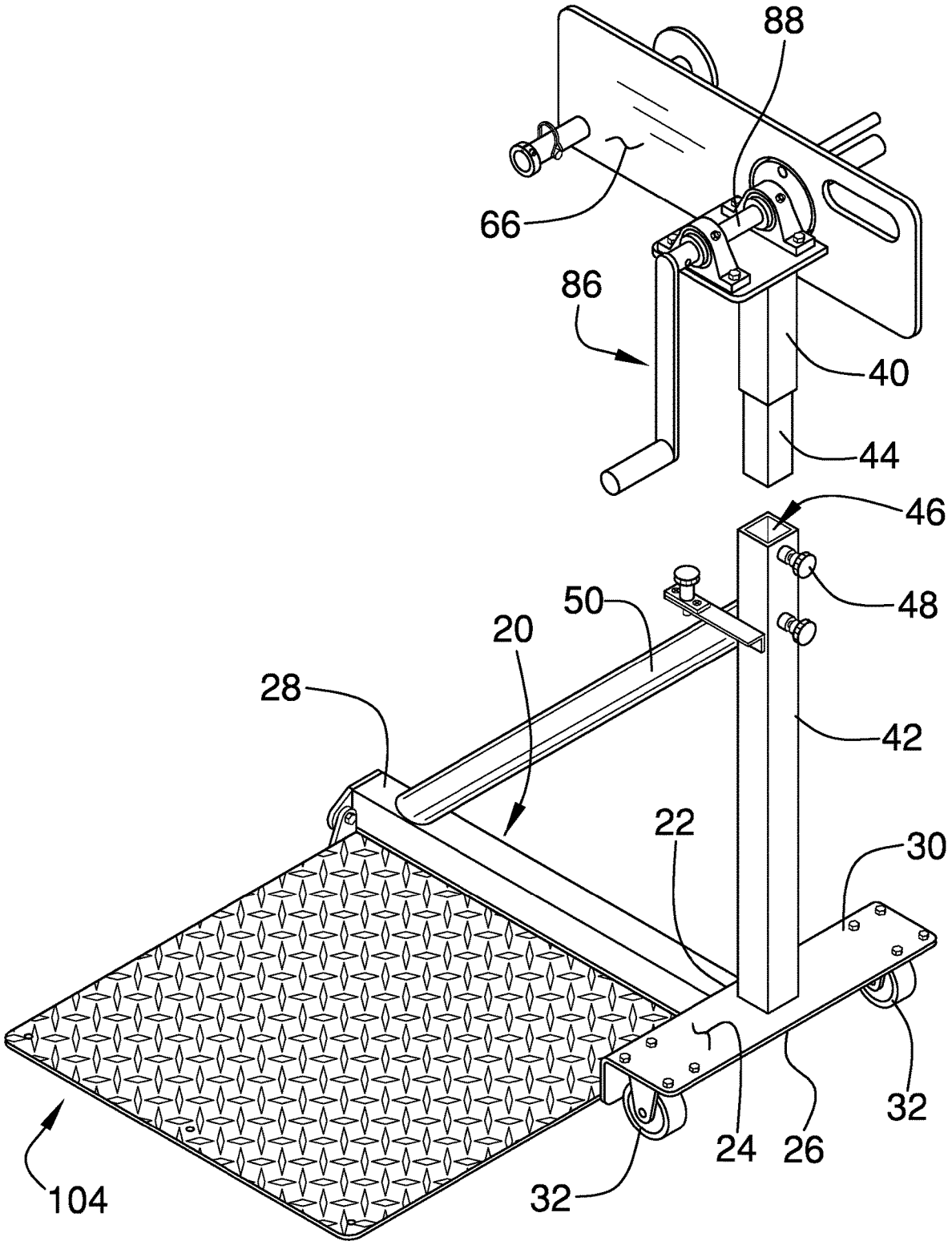
FIG. 2 is a left, top isometric view of an embodiment of the disclosure.
Figure 3:
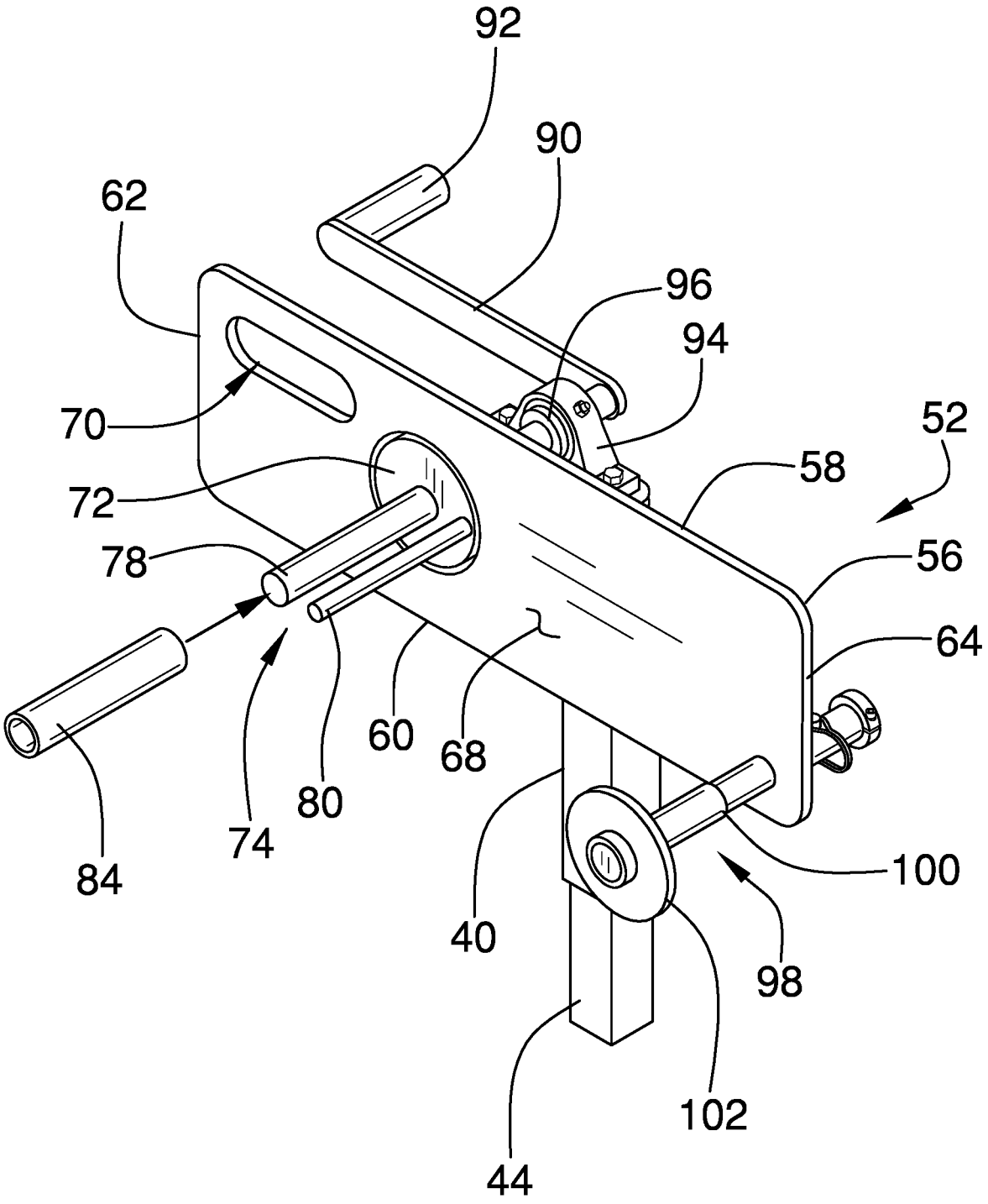
FIG. 3 is a right isometric view of a reel apparatus of an embodiment of the disclosure.

The support frame 12 further includes a post 34 that is attached to and extends upwardly from the base 22. The post 34 extends upwardly from the central area of the second member 30 and is spaced from the first 18 and second 20 lateral edges of the second member 30. The post 34 has an upper end 36 positioned distal to the base 22. In some embodiments, the post 34 has a break 38 therein to define an upper section 40 and a lower section 42 of the post 34. The upper section 40 includes a first mating member 44 and the lower section 42 includes a second mating member 46, wherein the first 44 and second 46 mating members are removably engaged to each other. In the embodiment of FIG. 2, the first mating member 44 is a male member that is insertable into the second mating member 46 comprising a sleeve. One or more locking members 48 may be added to releasably secure the first 44 and second 46 mating members together. The locking members 48 may comprise threaded fasteners that are extended into the lower section 42 to frictionally engage the upper section 40, for example. A brace 50 extends between and is attached to the first member 28 and the post 34 to buttress and stabilize the post 34.

A reel apparatus 52 is mounted on the post 34 adjacent to the upper end 36. The reel apparatus 52 is configured to engage a fire hose 54 and wind the fire hose 54 into a roll for storage and transportation purposes. The reel apparatus 52 includes a mounting plate 56 having a top edge 58, a bottom edge 60, a front edge 62, a rear edge 64, a first lateral side 66 and a second lateral side 68, wherein these directions correspond to the directions above relative to the support frame 12. The first 66 and second 64 lateral sides are vertical orientated and each is planar. Thusly, a plane of the mounting plate 56 is vertically orientated and the mounting plate 56 is positioned such that its plane is parallel to a longitudinal axis of the first member 28 that extends though, and may bisect, the second member 30. The post 34 may be aligned with the longitudinal axis of the first member 28 wherein the mounting plate 56 is offset from the longitudinal axis toward the second lateral edge 20 of the second member 30.

The mounting plate 56 is attached to the post 34. This may be accomplished by welding the post 34 to the mounting plate 56 and in particular to the first lateral side 66 of the mounting plate 56 to allow the first lateral side 66 of the mounting plate 56 to remain generally unencumbered with structural impediments that would interfere with the coiling of the fire hose 54. The mounting plate 56 has an aperture 70 extending therethrough that is positioned adjacent to a juncture of the front 62 and top 58 edges. The aperture 70 defines a grip to facilitate positioning of the system 10 and will allow the user to tilt the post 34 forward such that the support frame 12 rests upon the wheels 32 to facilitate rolling of the system 10 where needed.

A spindle 72 extends through the first 66 and second 68 lateral sides and is rotatable relative to the mounting plate 56. The spindle 72 is positioned nearer the front edge 62 than the rear edge 64. A hose coupler 74 is attached to, and forms a continuation of, the spindle 72 and extends away from the second lateral side 68. The hose coupler 74 has a structure that is configured to releasably engage a hose fluid coupling 76, which may comprise a male or female coupling. For example, the hose coupler 74 may include a first rod 78 and a second rod 80. The first rod 78 is orientated perpendicular to the second lateral side 68 and is axially aligned with the spindle 72. A second rod 80 is orientated perpendicular to the second lateral side 68 and is spaced from the first rod 78. A receiving space 82 is defined between the first 78 and second 80 rods to receive the fire hose 54 but through which the hose fluid coupling 76 cannot pass. A sleeve 84 may be positioned over the first rod 78 and is slidably removable from the first rod 78 to allow a roll of fire hose 54, that is positioned on the hose coupler 74, to be more easily removed from the system 10 as the fire hose 54 would otherwise frictionally engage the hose coupler 74 preventing the fire hose 54 from being removed from the system 10 without some uncoiling.

A handle 86 is attached to the spindle 72 and extends away from the first lateral side 66. As can be seen in the Figures, the handle 86 includes a shaft 88 that is aligned with the spindle 72 and may form a unitary structure with the first rod 78. A leverage bar 90 is perpendicularly attached to the shaft 88 and terminates in a grip 92 that is perpendicular to the leverage bar 90. The grip 92 may be rotationally coupled to the leverage bar 90. As shown in the Figures, the shaft 88 may be extended through stands 94 that are attached to the mounting plate 56 and post 34 to stabilize the shaft 88 and retain it in a perpendicular orientation relative to the mounting plate 56. The shaft 88 being stabilized by the mounting plate 56 as well as the stands 94, which may include radial bearings 96, distributes the weight of the fire hose 54 along the handle 86, spindle 72 and hose coupler 74.

Figure 5:
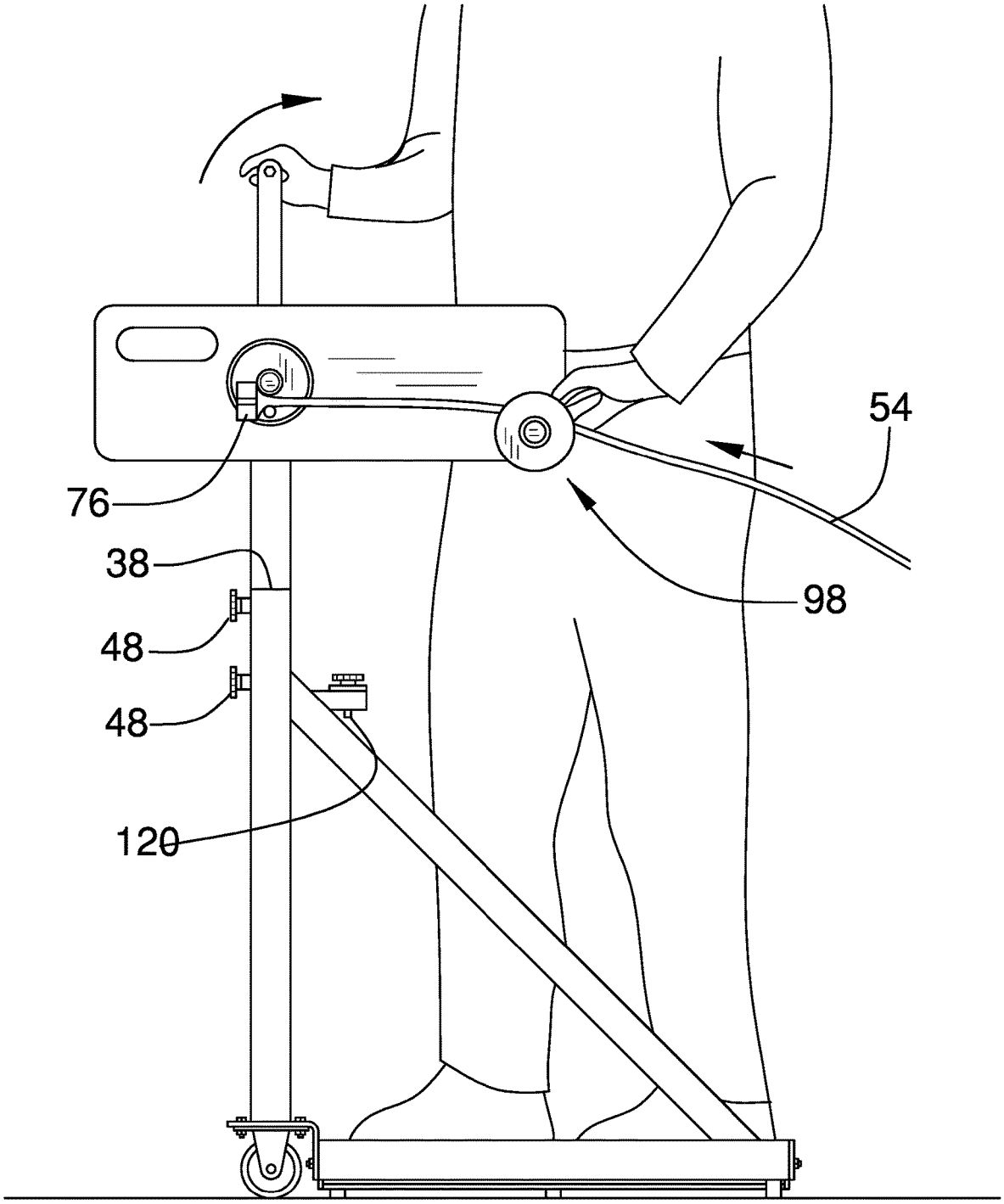
FIG. 5 is a right side view of an embodiment of the disclosure.
Figure 6:
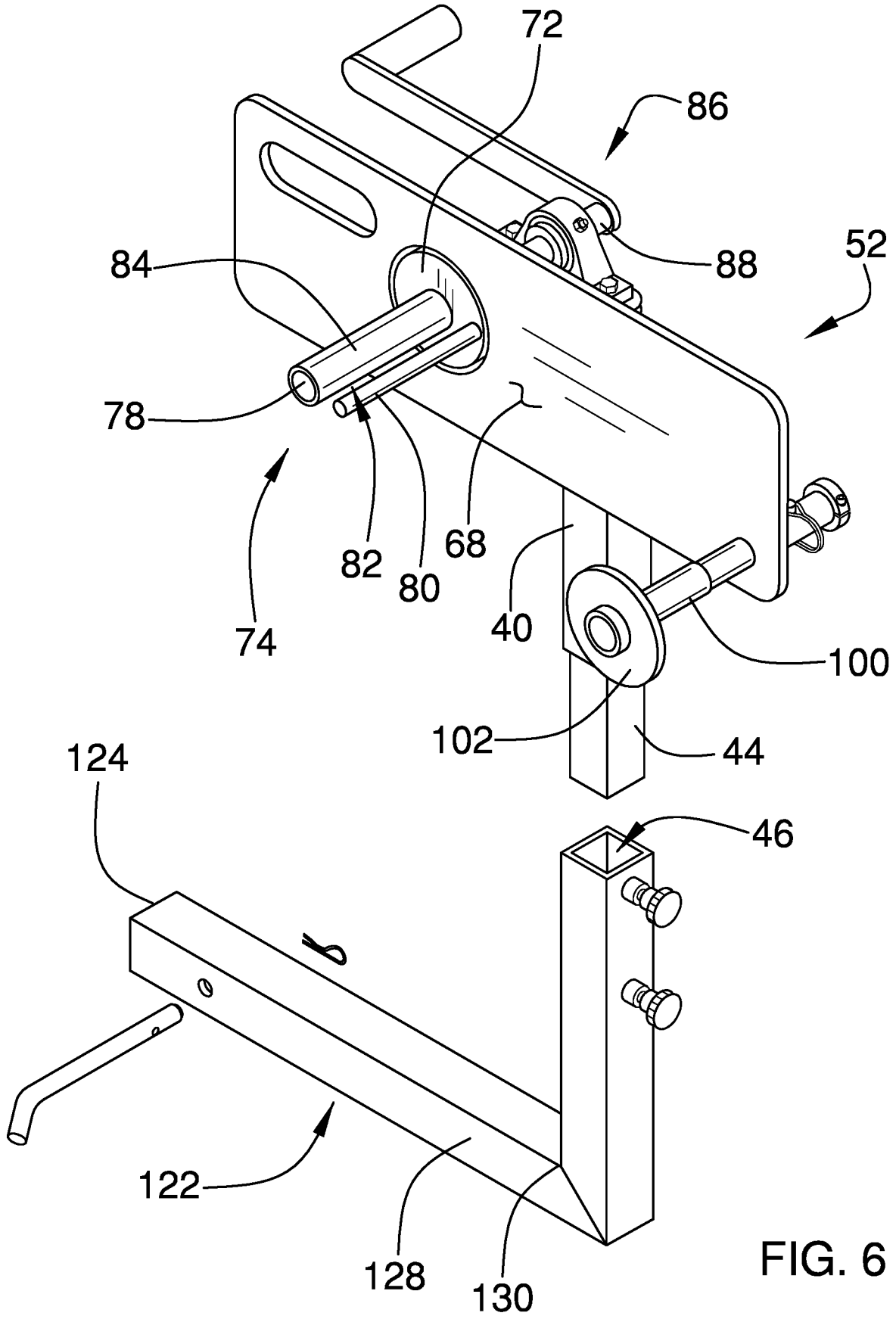
FIG. 6 is a right isometric view of a secondary support of an embodiment of the disclosure.
Figure 7:
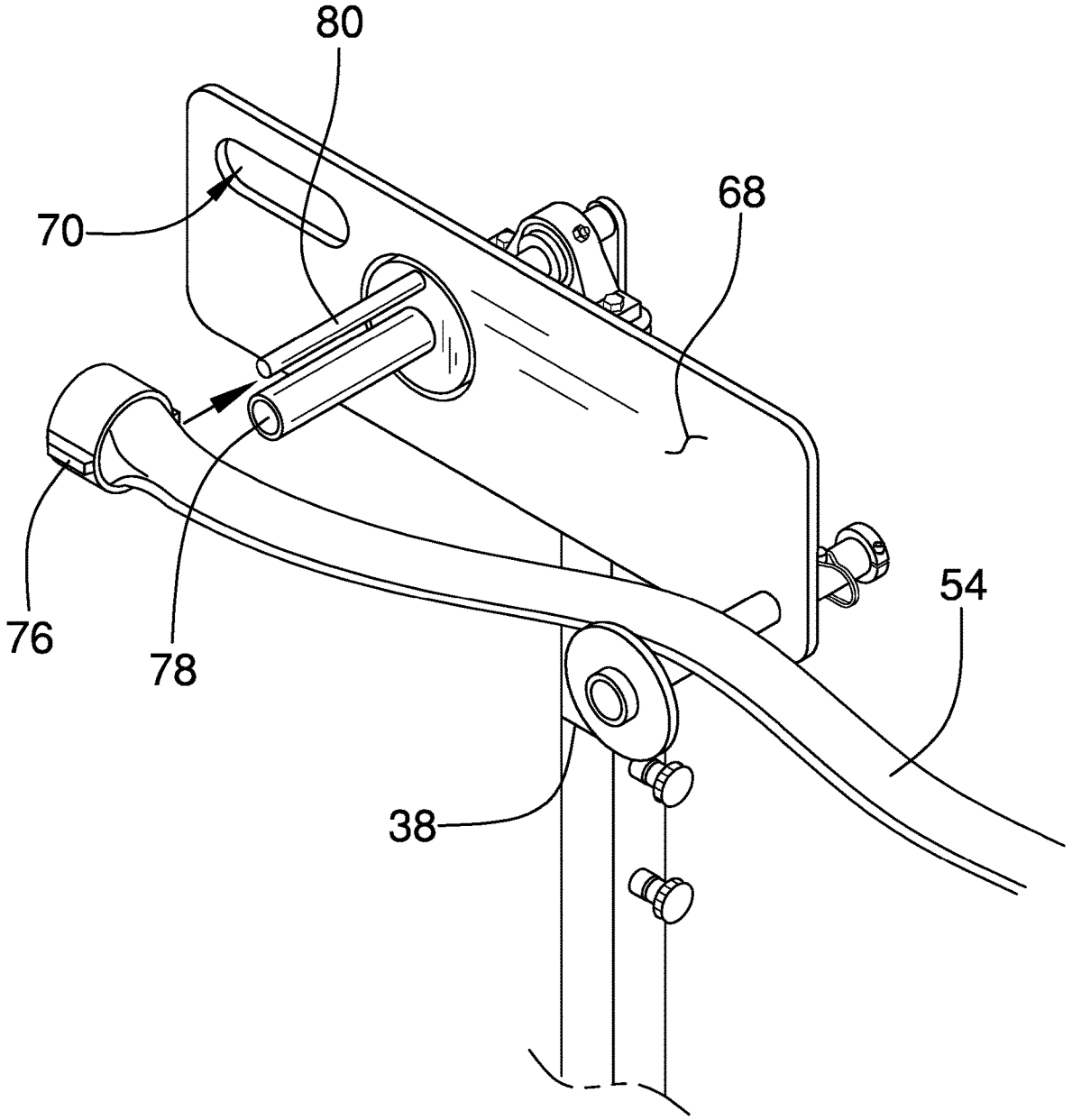
FIG. 7 is a right isometric view of an embodiment of the disclosure.
Figure 8:
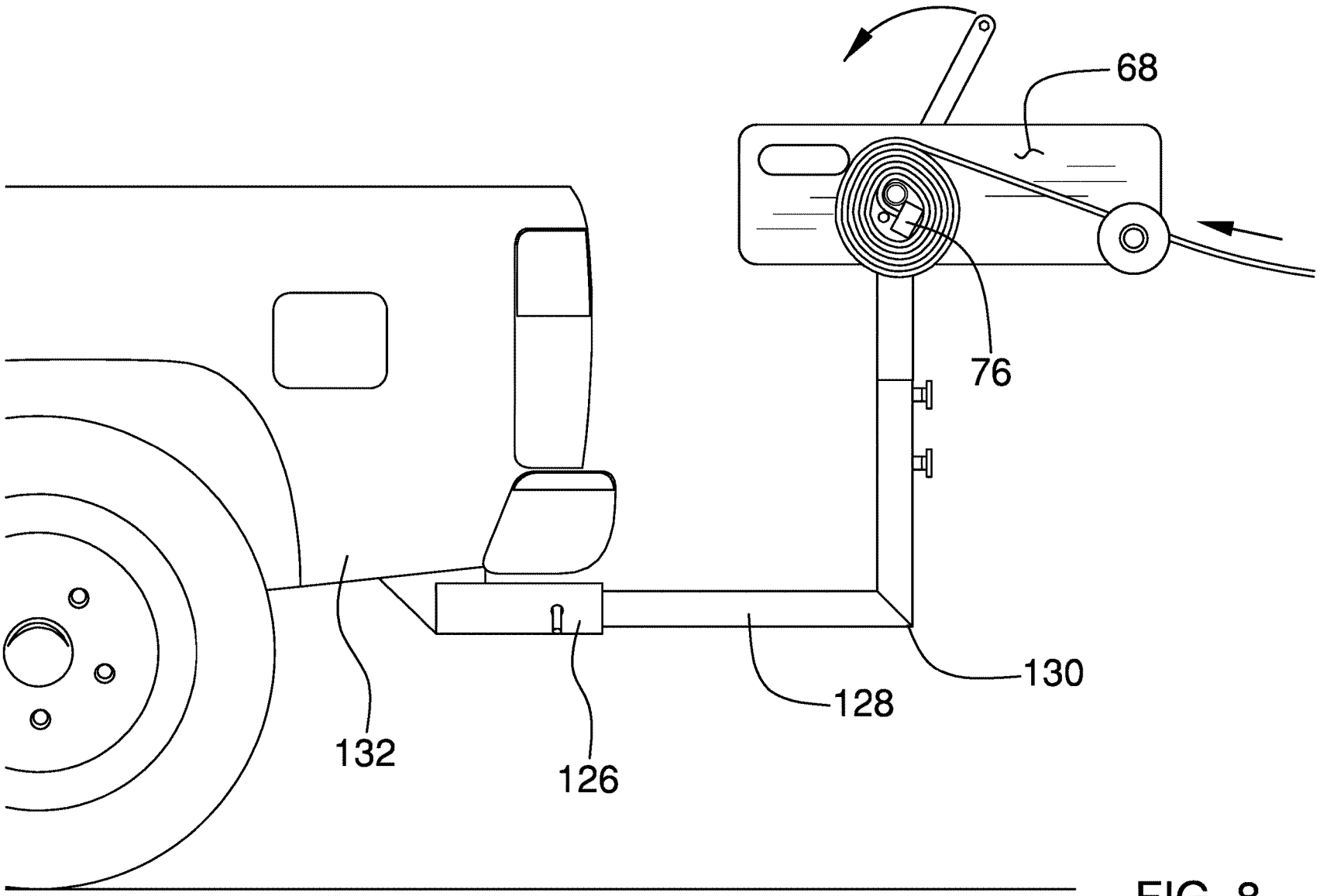
FIG. 8 is a right side view of an embodiment of the disclosure.
Figure 9:
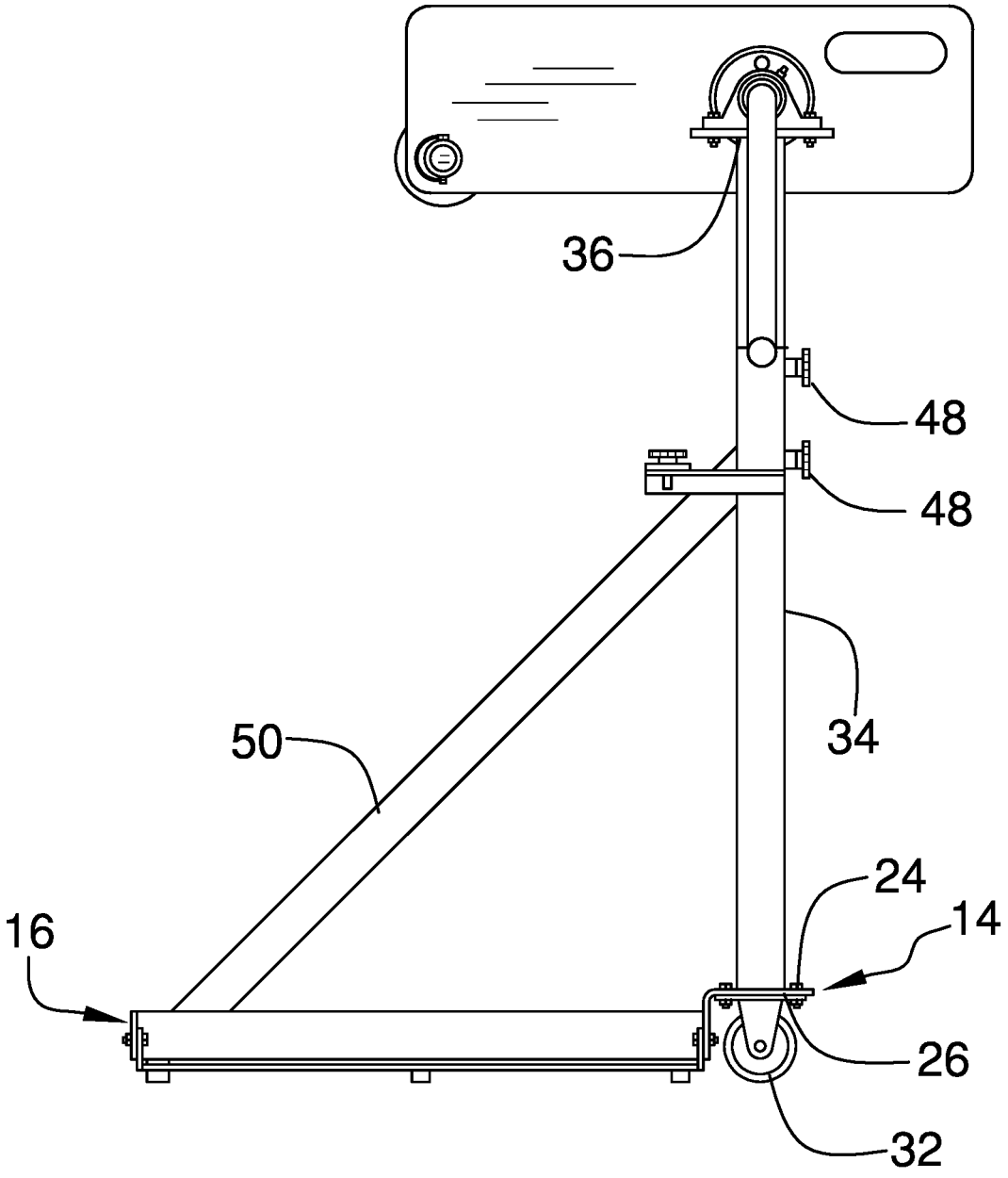
FIG. 9 is a left side view of an embodiment of the disclosure.

A guide 98 is attached to and extends away from the second lateral side 68. The guide 98 is configured to receive the hose 54 such that hose 54 remains aligned with the spindle 72, or hose coupler 74 of the spindle 72. The guide 98 is positioned nearer to the rear edge 64 than the front edge 62 and includes a tube 100 is orientated perpendicular to the second lateral side 68. An outer wall 102 is attached to the tube 100 distal to the mounting plate 56. The fire hose 54 is positionable on the tube 100 and bounded by the mounting plate 56 and outer wall 102 to keep the fire hose 54 properly aligned as is shown in FIG. 5. The guide 98 may be adjustable such that outer wall 102 is moveable toward or away from the second lateral side 68 to facilitate the widths of different fire hoses 54 being positioned on the guide 98. The guide 98 may be rotatable relative to the mounting plate 56 and furthermore may be removable from the mounting plate 56 for storage purposes.

Figure 4:
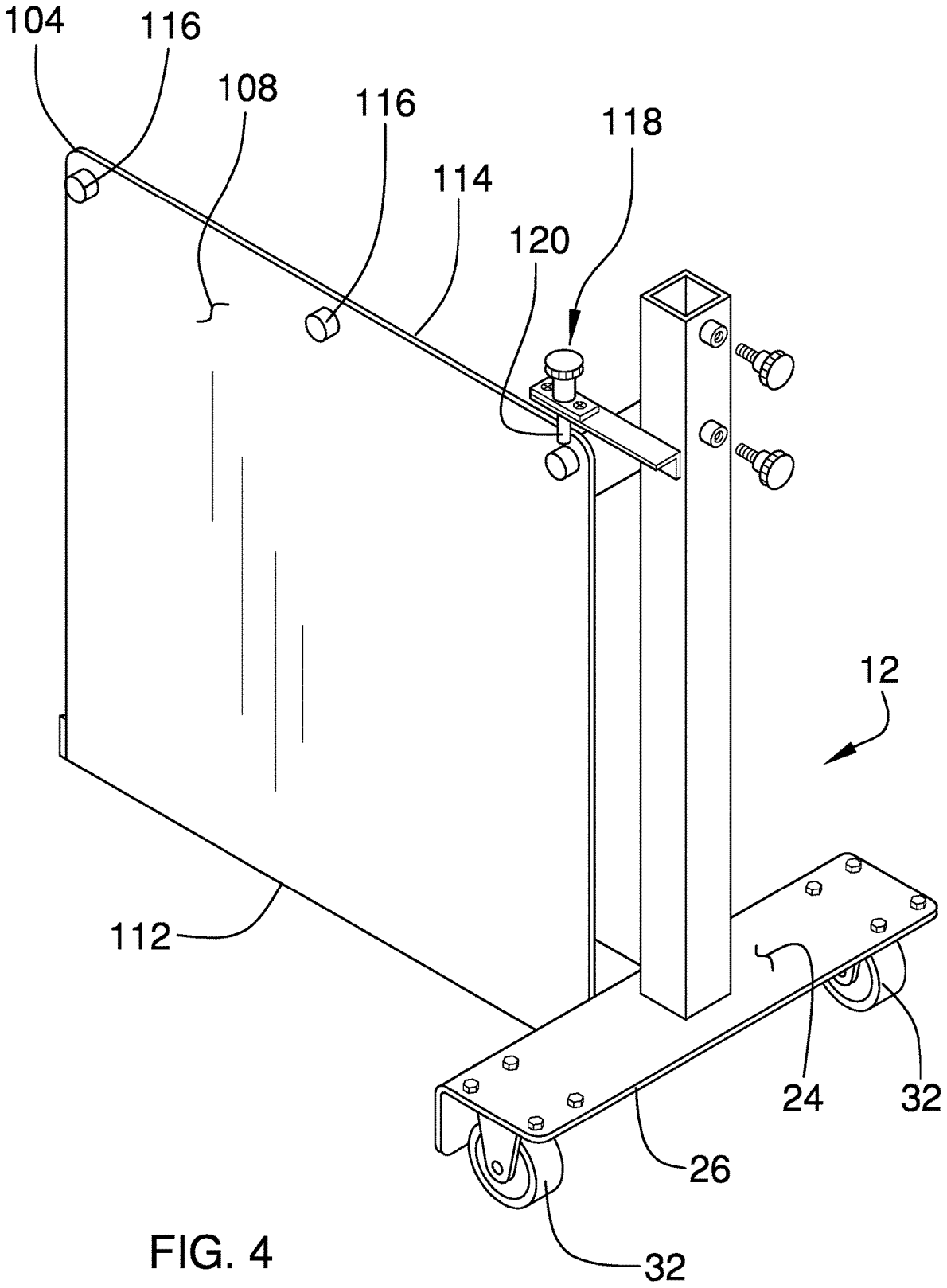
FIG. 4 is a left, top isometric view of a support frame of an embodiment of the disclosure.

A stabilizing panel 104 has an upper surface 106, a lower surface 108 and a perimeter edge 110. The perimeter edge 110 includes an interior edge 112 and an exterior edge 114 positioned opposite of each other. The stabilizing panel 104 is pivotally coupled to the support frame 12 such that the interior edge 112 is adjacent to the first lateral edge 18. The stabilizing panel 104 is positioned in an upright position, as shown in FIG. 4, extending upwardly from the interior edge 112 to define a stored position. The stabilizing panel 104 is positionable in a deployed position whereby the stabilizing panel 104 extends outwardly and laterally away from the first lateral edge 18. The stabilizing panel 104 abuts the ground surface and is stepped upon by a user of the system 10 during usage of the reel apparatus 52 to stabilize the support frame 12 and reel apparatus 52. By standing on the stabilizing panel 104, a user of the system 10 prevents movement of the system 10 which could otherwise be caused from the weight of the fire hose 54 being pulled toward the spindle 72. The stabilizing panel 104 will usually have a length and width each being at least 18.0 inches.

Figure 10:
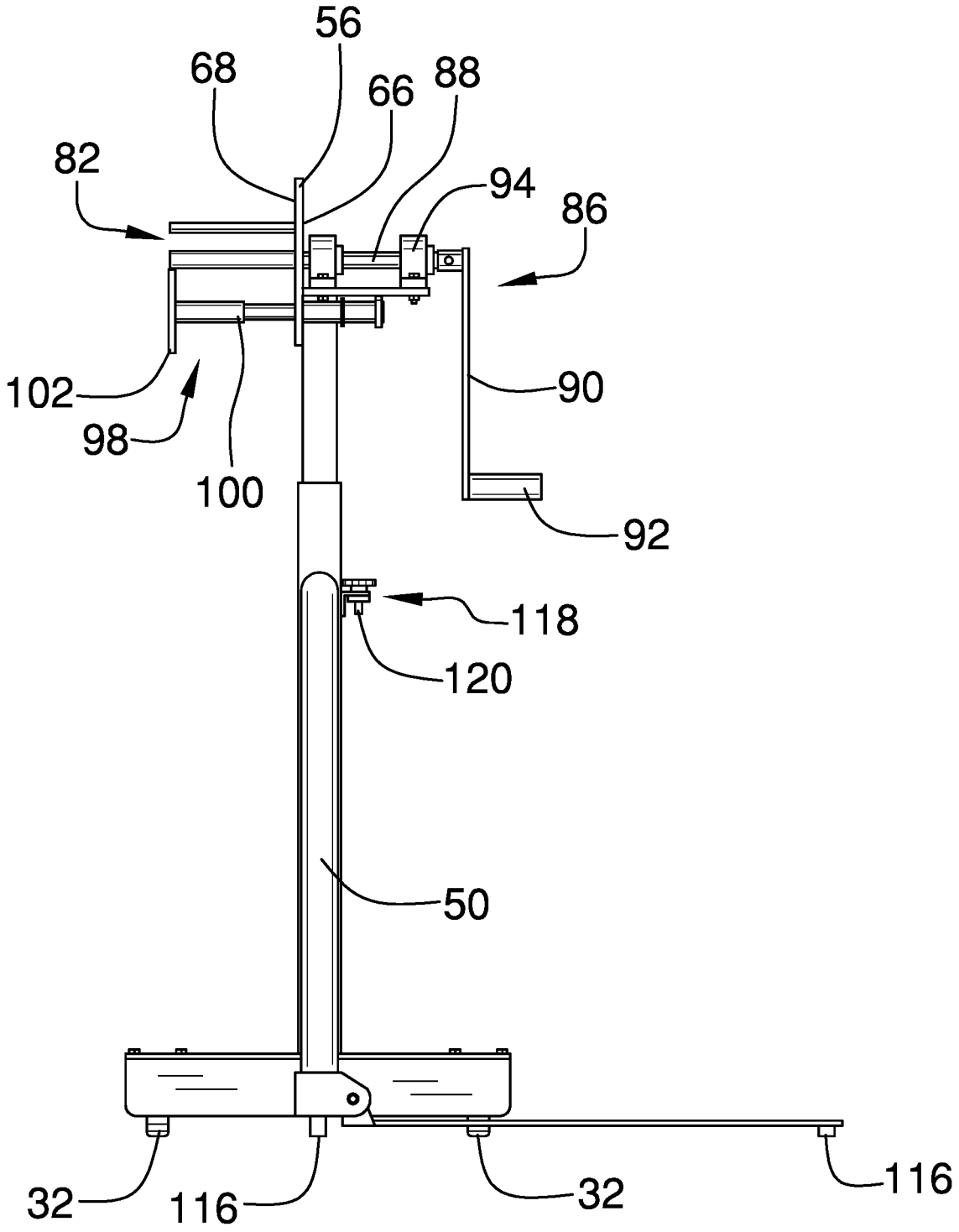
FIG. 10 is a front view of an embodiment of the disclosure.
Figure 11:
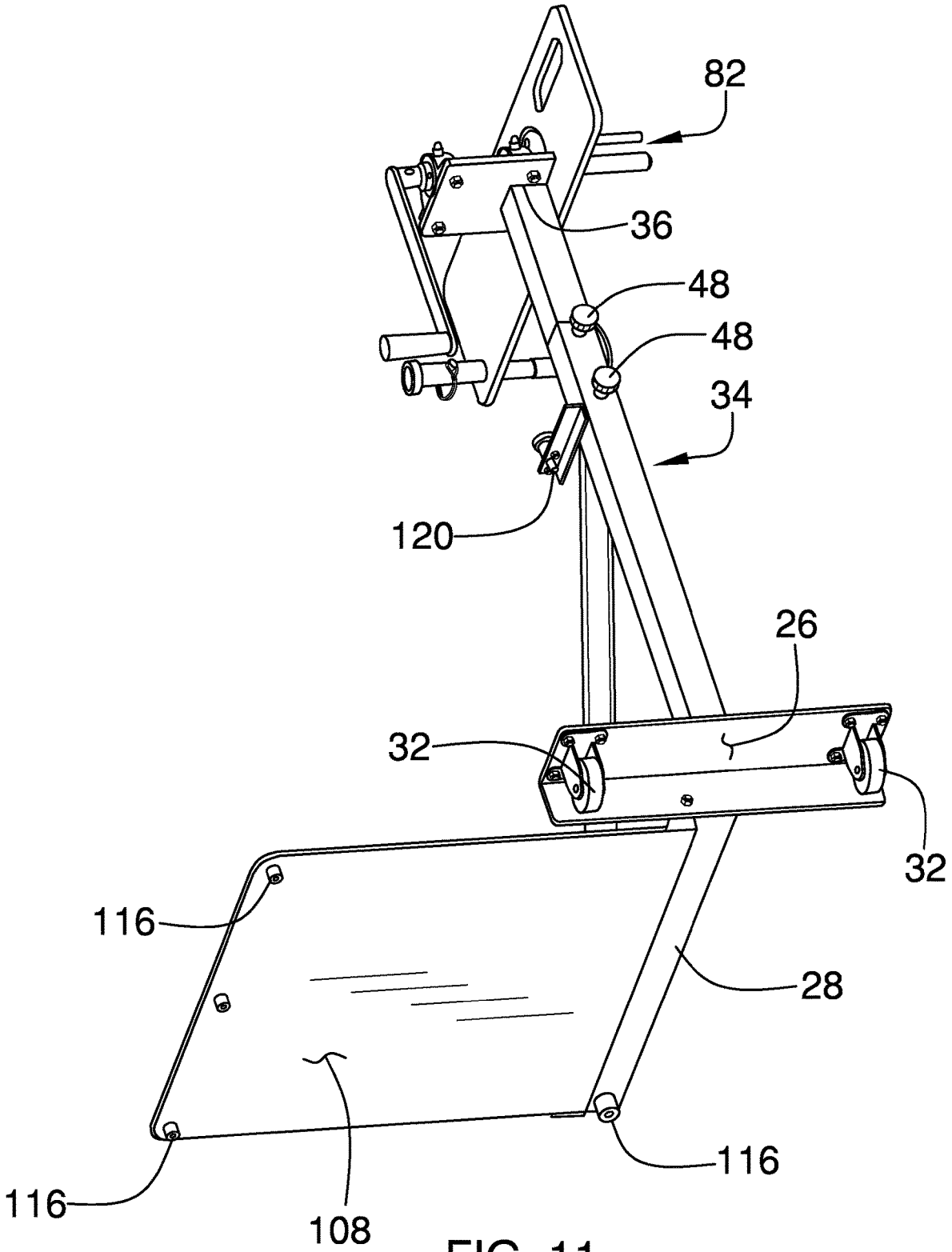
FIG. 11 is a bottom isometric view of an embodiment of the disclosure.
Figure 12:
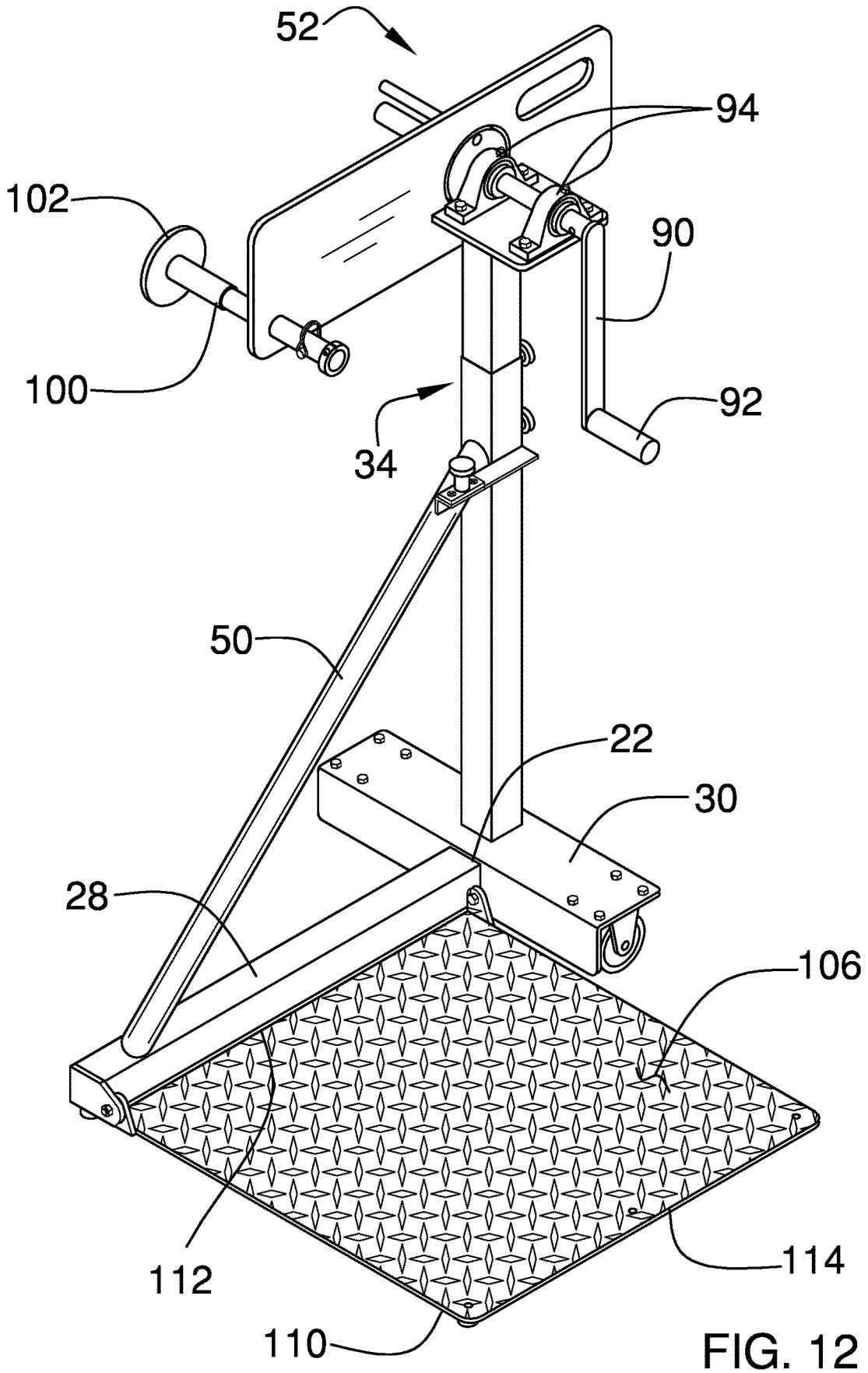
FIG. 12 is a top isometric view of an embodiment of the disclosure.

Included with the stabilizing panel 104 may be one or more feet 116 attached to the lower surface 108 to better engage the ground surface at defined areas and to better grip the ground surface. The first member 28 may also include one or more feet 116 to position the first member 28 at the same height as the stabilizing panel 104 when it is deployed. The upper surface 106 may include a friction enhancing material or include raised sections. A hold 118 may be mounted on the support frame 12 to releasably engage the stabilizing panel 104 to retain the stabilizing panel 104 in the stored position. The hold 118 may include a pin 120, for example, that is positioned to place the stabilizing panel 104 between the pin 120 and the brace 50 to prevent the stabilizing panel 104 from pivoting downwardly from the stored position. The pin 120 may be biased toward an engaged position as shown in FIG. 10 wherein the pin 120 must be urged out of the engage position to allow movement of the stabilizing panel 104 into, or out of, the store position.

A secondary retention apparatus 122 may be provided wherein the support frame 12, generally, is not utilized. The secondary retention apparatus 122 includes a conventional hitch connector 124 that is removably engageable with a hitch receiver 126. The hitch connector 124 is attached to a bar 128 having a bend 130 therein such that an end of the bar opposite of the hitch connector 124 is directed upwardly. The opposite end includes another one of the second mating members 46. This allows the first mating member 44 to be engaged with the secondary retention apparatus 122 while utilizing a vehicle 132 as a stabilizer for the reel apparatus 52. Thus, the system 10 provides for the ability to be selectively releasable from and engageable with either the support frame 12 or the secondary retention apparatus 122.

In use, the user will attach the reel apparatus 52 to the lower section 42 of the post 34 and then will lower stabilizing panel 104 as is shown in FIG. 1. The sleeve 84 will be placed on the first rod 78 and the user will take the hose fluid coupling 76 of a fire hose 54 to extend it between first 78 and second 80 rods. If the fire hose 54 has not been placed on the guide 98, the fire hose 54 will at this time be placed on the guide 98. The user will stand on the stabilizing panel 104 to prevent the movement of the support frame 12 and the handle 86 used to rotate the spindle 72 and hose coupler 74 to wind the fire hose 54 onto the hose coupler 74. Once the entire fire hose 54 has been coiled onto the hose coupler 74, the fire hose 54 and the sleeve 84, if used, are slid off of the hose coupler 74 so that the fire hose 54 can be properly stowed. Should the fire hose 54 be coiled adjacent to a vehicle 132, a user of the system 10 may utilize the secondary retention apparatus 122.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fire hose rolling assembly configured to assist a person in rolling a fire hose for storage and transportation purposes, the assembly comprising:

a support frame being positionable on a ground surface, the support frame having a front end, a rear end, a first lateral edge and a second lateral edge;

a reel apparatus being mounted on a post adjacent to an upper end of the post, the reel apparatus being configured to releasably engage a fire hose and form the hose into a roll when the reel apparatus is actuated; and a stabilizing panel having an upper surface, a lower surface and a perimeter edge, the perimeter edge including an interior edge and an exterior edge positioned opposite of each other, the stabilizing panel being pivotally coupled to the support frame such that the interior edge is adjacent to the first lateral edge, the stabilizing panel being positioned in an upright position extending upwardly from the interior edge to define a stored position or in deployed position laterally extending away from the first lateral edge, wherein the stabilizing panel abuts the ground surface and is stepped upon while the reel apparatus is used to stabilize the assembly.

2. The fire hose rolling assembly according to claim 1, wherein the support frame includes a base having a top side and a bottom side and a plurality of wheels being attached to and extending downwardly from the bottom side.

3. The fire hose rolling assembly according to claim 2, wherein the base includes a first member and a second member being orientated perpendicular to each other such that the first member extends away from a central area of the second member, the second member including the front end, the wheels being located on the second member.

4. The fire hose rolling assembly according to claim 2, wherein the support frame further includes the post being attached to and extending upwardly from the base, the reel apparatus being attached to the post.

5. The fire hose rolling assembly according to claim 3, wherein the support frame further includes the post being attached to and extending upwardly from the base, the reel apparatus being attached to the post.

6. The fire hose rolling assembly according to claim 5, wherein the post extends upwardly from the central area of the second member and being spaced from the first and second lateral edges, the post having a break therein to define an upper section and a lower section of the post, the upper section including a first mating member and the lower section including a second mating member, the first and second mating members being removably engaged to each other.

7. The fire hose rolling assembly according to claim 6, wherein the reel apparatus includes:

a mounting plate having a top edge, a bottom edge, a front edge, a rear edge, a first lateral side and a second lateral side, the first and second lateral sides being vertical orientated, a plane of the mounting plate being vertically orientated and being parallel to a longitudinal axis of the first member extending though the second member, the mounting plate being attached to the post;

a spindle extending through the first and second lateral sides and being rotatable relative to the mounting plate, the spindle being positioned nearer the front edge than the rear edge;

a hose coupler being attached to the spindle and extending away from the second lateral side, the hose coupler being configured to releasably engage a hose fluid coupling; and a handle being attached to the spindle and extending away from the first lateral side.

8. The fire hose rolling assembly according to claim 7, wherein the hose coupler includes a first rod being orientated perpendicular to the second lateral side and being axially aligned with the spindle, a second rod being orientated perpendicular to the second lateral side and being spaced from the first rod, wherein a receiving space is defined between the first and second rods to receive the hose.

9. The fire hose rolling assembly according to claim 8, further including a guide being attached to and extending away from the second lateral side of the mounting plate, the guide being configured to receive and retain a positioning of the hose as the hose is wound onto the spindle.

10. The fire hose rolling assembly according to claim 9, wherein the guide is positioned nearer to the rear edge than the front edge, the guide including a tube being orientated perpendicular to the second lateral side, an outer wall being attached to the tube distal to the mounting plate, wherein the hose is positionable on the tube and bounded by the mounting plate and outer wall.

11. The fire hose rolling assembly according to claim 7, wherein the plate has an aperture extending therethrough, the aperture being positioned adjacent to a juncture of the front and top edges, the aperture defining a grip to facilitate positioning of the assembly.

12. The fire hose rolling assembly according to claim 1, further including a hold being mounted on the support frame, the hold releasably engaging the stabilizing panel to retain the stabilizing panel in the stored position.

13. The fire hose rolling assembly according to claim 6, further including a secondary retention apparatus including a hitch connector being removably engageable with a hitch receiver, the secondary retention apparatus including another one of the second mating members, wherein the reel apparatus is selectively releasable from the support frame and engageable with the secondary retention apparatus.

14. The fire hose rolling assembly according to claim 1, wherein the reel apparatus includes:

a mounting plate having a top edge, a bottom edge, a front edge, a rear edge, a first lateral side and a second lateral side, the first and second lateral sides being vertical orientated, a plane of the mounting plate being vertically orientated;

a spindle extending through the first and second lateral sides and being rotatable relative to the mounting plate, the spindle being positioned nearer the front edge than the rear edge;

a hose coupler being attached to the spindle and extending away from the second lateral side, the hose coupler being configured to releasably engage a hose fluid coupling; and a handle being attached to the spindle and extending away from the first lateral side.

15. The fire hose rolling assembly according to claim 14, wherein the hose coupler includes a first rod being orientated perpendicular to the second lateral side and being axially aligned with the spindle, a second rod being orientated perpendicular to the second lateral side and being spaced from the first rod, wherein a receiving space is defined between the first and second rods to receive the hose.

16. The fire hose rolling assembly according to claim 14, further including a guide being attached to and extending away from the second lateral side of the mounting plate, the guide being configured to receive and retain a positioning of the hose as the hose is wound onto the spindle.

17. The fire hose rolling assembly according to claim 15, wherein the guide is positioned nearer to the rear edge than the front edge, the guide including a tube being orientated perpendicular to the second lateral side, an outer wall being attached to the tube distal to the mounting plate, wherein the hose is positionable on the tube and bounded by the mounting plate and outer wall.

18. The fire hose rolling assembly according to claim 14, wherein the plate has an aperture extending therethrough, the aperture being positioned adjacent to a juncture of the front and top edges, the aperture defining a grip to facilitate positioning of the assembly.

* * * * *